United States Patent [19]

Kawasaki et al.

[11] 4,190,506

[45] Feb. 26, 1980

[54] ELECTROLYSIS OF ALKALI METAL CHLORIDE

[75] Inventors: Nobuhiro Kawasaki; Naoki Yoshida; Takashi Yoshitugu, all of Shin-nanyo, Japan

[73] Assignee: Toyo Soda Manufacturing Co., Ltd., Yamaguchi, Japan

[21] Appl. No.: 961,553

[22] Filed: Nov. 17, 1978

[30] Foreign Application Priority Data

Jan. 11, 1978 [JP] Japan ..... 53-1119

[51] Int. Cl.[2] ..... C25B 1/16; C25B 1/26; C25B 13/06

[52] U.S. Cl. ..... 204/98; 204/128; 204/295

[58] Field of Search ..... 204/295, 98, 128

[56] References Cited

U.S. PATENT DOCUMENTS

| | | | |
|---|---|---|---|
| 3,723,264 | 3/1973 | Le Duc et al. | 204/295 |
| 4,093,533 | 6/1978 | Beaver et al. | 204/295 |

*Primary Examiner*—R. L. Andrews

*Attorney, Agent, or Firm*—Oblon, Fisher, Spivak, McClelland & Maier

[57] ABSTRACT

An alkali metal chloride is electrolyzed in a diaphragm electrolytic cell equipped with an asbestos diaphragm prepared by using asbestos fiber fluffed with a turbo rotary mill before fabrication.

6 Claims, 4 Drawing Figures

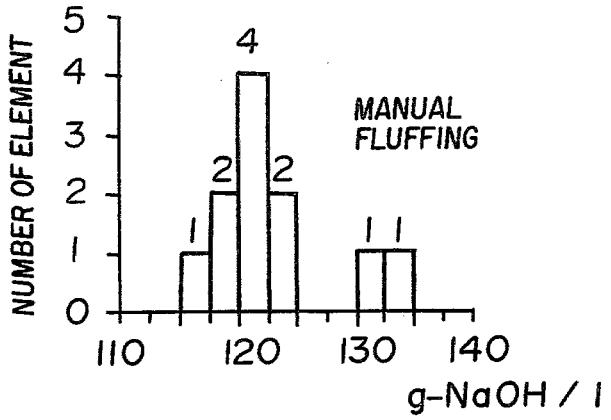
FIG. 3
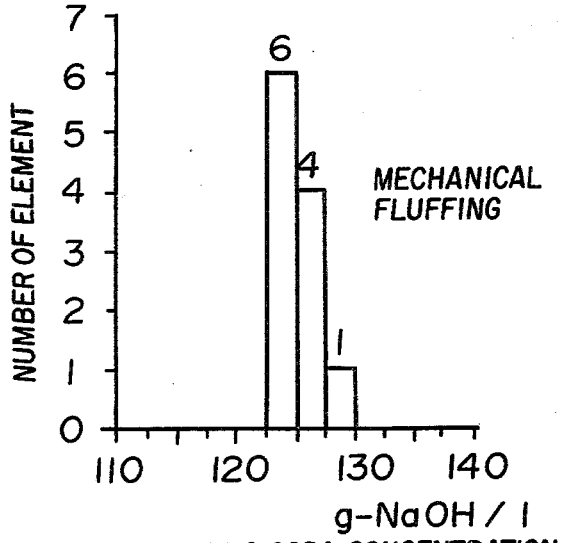
FIG. 4
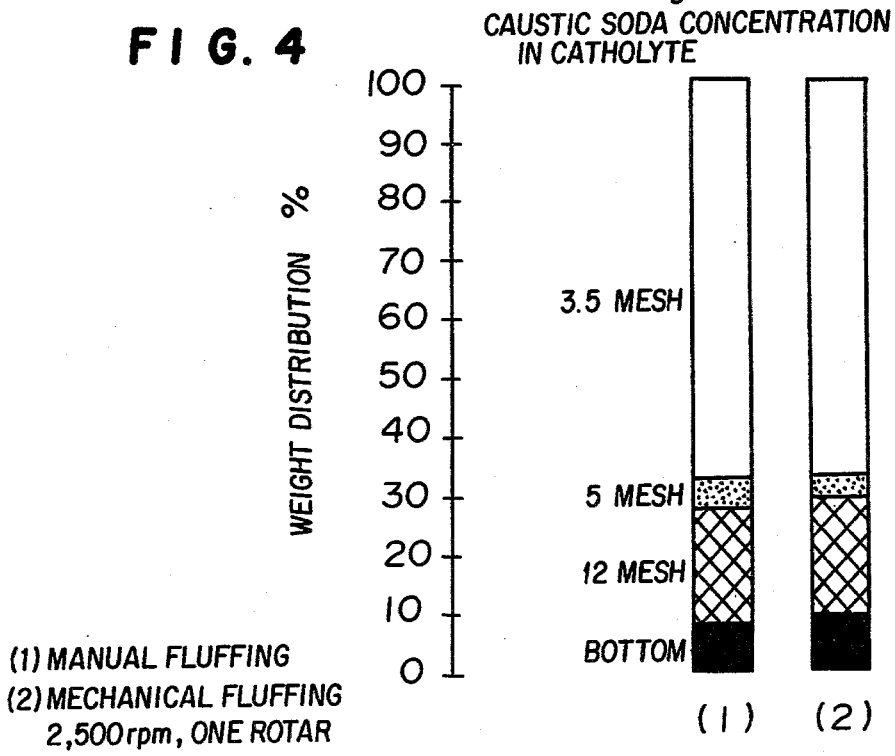

ELECTROLYSIS OF ALKALI METAL CHLORIDE

BACKGROUND OF THE INVENTION

The present invention relates to a diaphragm electrolysis of an alkali metal chloride.

The conventional asbestos diaphragm used for a diaphragm electrolysis of an alkali metal chloride is classified into three types; a diaphragm using the asbestos fiber without any prefabrication, a diaphragm of a cloth obtained by weaving the asbestos fiber, and a diaphragm of a sheet obtained by sheeting the asbestos fiber.

When the asbestos fiber is used without any prefabrication, the asbestos fiber is suspended in an solution of a base such as sodium hydroxide and a wire net cathode is dipped in the suspension and the solution is removed under a suction so as to deposit the asbestos fiber on the wire whereby the diaphragm is obtained.

When the diaphragm is prepared by such a method, the commercial asbestos fiber is packed under compression for the purpose of reducing the bulk from the viewpoint of transportation efficiency. Accordingly, the asbestos fiber is fluffed when used for the preparation of the diaphragm.

The operation for fluffing the asbestos fiber is preferably performed while minimizing the break of asbestos fiber and accordingly, a hand operation for fluffing the asbestos fiber has been employed. The hand operation for fluffing the asbestos fiber requires great labour and a long time and it is subjected to regulation for environmental hygiene to prevent the scattering of the asbestos fiber in the atmosphere.

In an electrolysis of an alkali metal chloride by using an asbestos diaphragm prepared by using the asbestos fiber fluffed by the hand operation, the concentration of sodium hydroxide in a catholyte is different among the individual cells. For example, in a bipolar type electrolytic cell having eleven electrolytic compartments (elements), the concentration of sodium hydroxide is distributed in a wide range from 155 to 135 g/liter. This causes a local deterioration which affects the life of the diaphragm and this disadvantageously affects the operating life of the electrolytic cell.

Accordingly, it is necessary to decrease the concentration difference of sodium hydroxide among the compartments and to increase the concentration of sodium hydroxide in the catholyte and thusly reduce the amount of steam used in the concentrating process for the sodium hydroxide.

The conventional asbestos diaphragm also has disadvantages of lower current efficiency and high concentration of sodium chlorate in the catholyte.

SUMMARY OF THE INVENTION

It is an object of the present invention to overcome the above-mentioned disadvantages and to provide a diaphragm electrolysis of an alkali metal chloride to give uniform concentrations of an alkali hydroxide in compartments of an electrolytic cell and to prevent the scattering of asbestos fiber in the preparation of an asbestos diaphragm.

The foregoing and other objects of the present invention have been attained by using an asbestos diaphragm prepared by asbestos fiber fluffed by a turbo rotary mill before fabrication.

DETAILED DESCRIPTION OF THE PREFERRED EMBODIMENTS

The turbo rotary mill used for fluffing the asbestos fiber in the present invention has a mechanism of imparting impacts by blades rotated at high speed and supersonic eddy flows formed at the rear of the blades and high frequency vibration caused by the eddy flows. One commercial turbo rotary mill is Turbo-Mill (manufactured by Turbo Kogyo K.K.). The turbo rotary mill is effective for fluffing asbestos fiber with a minimum breakage of the asbestos fiber.

The turbo rotary mill can be any kind of mill that imparts impacts and shocks without a sharp knife edge.

In order to attain the effect of the present invention for providing uniform thickness and uniform structure in the fabrication, the revolution speed of the turbo rotary mill is preferably in a range of 2,000 to 5,000 rpm especially 2,500 to 3,000 rpm, though it depends upon a type of the turbo rotary mill.

One typical turbo rotary mill has a rotor having many partitions in the radial direction and many blades disposed between adjacent partitions and a cover for covering the rotor with small gap, and an inlet hopper connected to the center of the rotor and an outlet connected to the cover. The blades of the turbo rotary mill have no sharp knife edge and they are similar to turbine blades.

In accordance with the present invention, the current efficiency in an electrolysis of an alkali metal chloride is higher by about one percent and the concentration of sodium chlorate in a catholyte is lower by 0.01 to 0.02 g/liter in comparison with those of an electrolysis using an asbestos diaphragm prepared by fluffing with hands. Moreover, the concentration of sodium chlorate in the catholyte can always be maintained and the variation of the concentration of sodium hydroxide can be decreased to a narrow range such as 122.5 to 130 g/liter). Accordingly, the concentration of sodium hydroxide in the catholyte can be increased and a stable operation can be attained, and the life of the asbestos diaphragm can be prolonged about 1.5 times in comparison with those of the asbestos diaphragm prepared by fluffing with hands.

The reason why such effect is imparted is not clear. Thus, it is considered that the asbestos diaphragm prepared by fluffing the asbestos fiber by the turbo rotary mill has uniform thickness and uniform structure whereby the flow speed and the amount of an electrolyte passing through the diaphragm are uniform without local difference.

Moreover, the asbestos fiber is fluffed by a closed machine whereby the problem of environmental hygiene can be prevented and the time required for fluffing the asbestos fiber can be significantly shortened.

The fluffed asbestos fiber is usually suspended in an aqueous solution such as an aqueous solution of an alkali metal hydroxide to form a suspension and the asbestos fiber is deposited on a wire net under suction to form the asbestos diaphragm. This is well-known by persons skilled in the arts and accordingly, it should be understood from the well-known arts.

The present invention will be further illustrated by certain examples which shall be interpreted as illustrative and not in a limiting sense.

EXAMPLE AND REFERENCE

A raw material of asbestos fiber (manufactured by Johns Manville Cooperation in Canada) was fluffed by hand while minimizing the breakage of the asbestos fiber. The same asbestos fiber was fluffed by a turbo rotary mill (Turbo-mill T-400 manufactured by Turbo Kogyo K.K.) at 2,500 rpm with one rotor.

Each fluffed asbestos fiber was suspended in a catholyte and it was deposited on a wire net cathode for a diaphragm electrolysis of an alkali metal chloride, under suction whereby an asbestos diaphragm was formed on the cathode. Each resulting asbestos diaphragm was used as the diaphragm for the electrolysis of an aqueous solution of sodium chloride in a bipolar type electrolytic cell having eleven compartments. The electrolysis was carried out to obtain sodium hydroxide.

As the result, as shown in Table 1, the current efficiency in the case of fluffing with the turbo rotary mill was higher than that of fluffing with hands by around one percent. As shown in Table 2, the concentration of sodium chlorate in the catholyte in the case of fluffing the asbestos fiber with the turbo rotary mill was lower than that of fluffing with hands by 0.01 to 0.02 g/liter. The bath concentration were always maintained in the case of fluffing the asbestos fiber with the turbo rotary mill.

As shown in Table 3, each concentration of sodium hydroxide in each catholyte discharged from each compartment was measured after 1 week of operation. In the case of fluffing the asbestos fiber with the turbo rotary mill, the concentration of sodium hydroxide in the eleven compartments was in the range of 122.5 to 130 g/liter. On the other hand, in the case of fluffing with hands, the concentrations of sodium hydroxide were widely varied in a range of 115 to 135 g/liter.

When each electrolysis was continued for a long time. In the case of loosening the asbestos fiber with hands, the oxygen concentration in the chlorine gas could not be maintained less than 3.5 vol. % after 12 months operation, though the operation was controlled in the optimum condition. This means the end of the diaphragm life. On the other hand, in the case of fluffing the asbestos fiber with the turbo rotary mill, the oxygen concentration in chlorine gas could be maintained less than 3.5 vol. % up to 18 months operation when the operation was controlled in the optimum condition.

FIG. 4 shows distributions of sizes of asbestos fibers measured by seiving with sieves of 3.5 mesh, 5 mesh and 12 mesh(made of brass wire).

As it is clear from the graphs, the break of the asbestos fiber fluffed with the turbo rotary mill under the condition of 2,500 rpm and 1 rotor was not substantial in comparison with the break of the asbestos fiber fluffed with hands.

The graphs of FIGS. 1 to 4 are briefly described.

Figure 1:
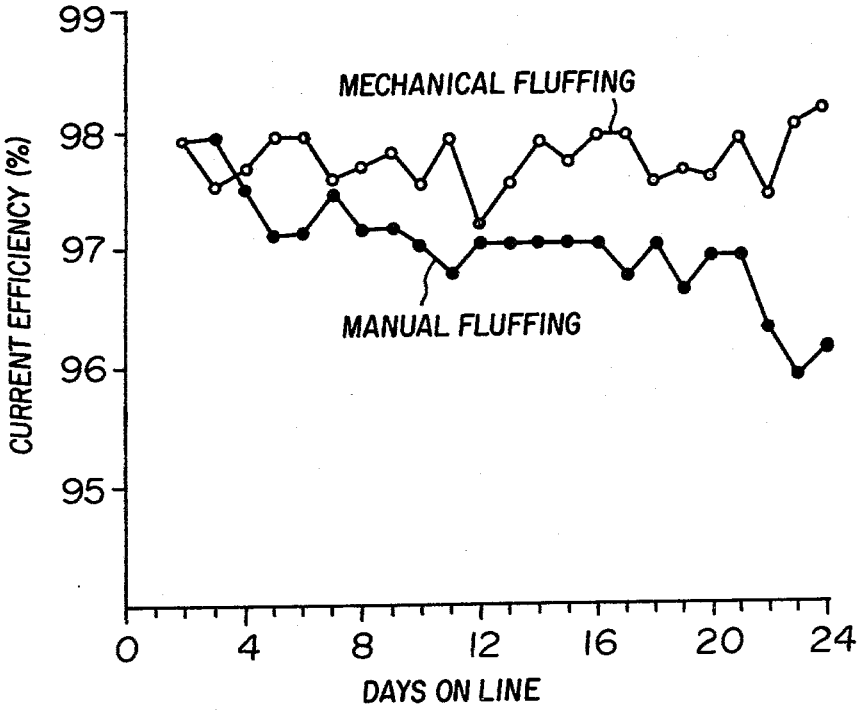
FIG. 1 shows the variations of current efficiency from initiation to 24 days from the start-up in each electrolysis of an aqueous solution of sodium chloride in each bipolar diaphragm electrolytic cell (eleven compartments) equipped with asbestos diaphragms prepared by using asbestos fiber fluffed with hands and with the turbo rotary mill, respectively.
Figure 2:
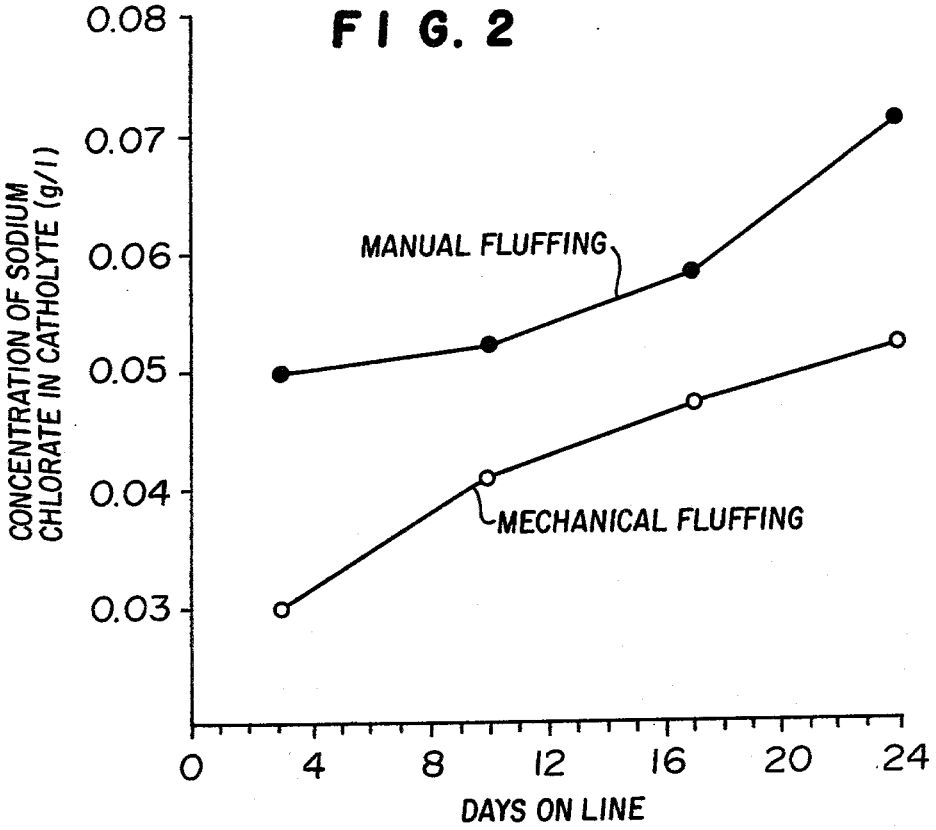
FIG. 2 shows the variations of sodium chlorate concentration in each catholyte by the same operations for FIG. 1.

FIG. 3 shows the distributions of sodium hydroxide concentration in each catholyte discharged from each compartment (a concentration of NaOH in a catholyte as g-NaOH/liter) in each electrolysis of an aqueous solution of sodium chloride in each bipolar diaphragm electrolytic cell (eleven compartments) equipped with asbestos diaphragms prepared by using asbestos fiber fluffed with hands or with the turbo rotary mill under the condition that the liquid level difference between the anolyte and the catholyte is kept the same.

FIG. 4 shows the weight distributions of asbestos fibers measured by seiving with seives of 3.5 mesh, 5 mesh and 12 mesh (made of brass wire) for each asbestos fiber fluffed with hands or with the turbo rotary mill.

What is claimed is:

1. A method of electrolyzing an alkali metal chloride in a diaphragm electrolytic cell equipped with an asbestos diaphragm wherein said diaphragm is made, without the use of a polyameric binder, by the process comprising the steps of:

fluffing an asbestos fiber with a turbo rotary mill, with substantially no breakage of the asbestos fiber;

suspending the fluffed asbestos in a solution of a base; and depositing the suspended asbestos fiber on a wire net cathode for diaphragm electrolysis of an alkali metal chloride.

2. A method according to claim 1 wherein the asbestos fiber is fluffed with a turbo rotary mill equipped with blades having no knife-like edge.

3. A method according to claim 1 wherein the asbestos fiber is fluffed with a turbo rotary mill equipped with many blades disposed in substantially radial direction between discs of a rotor so as to beat the asbestos fiber without breaking it.

4. A method according to claim 1 wherein the asbestos fiber is fluffed with a turbo rotary mill equipped with one step rotor having many blades extended in radial directions between plural discs.

5. A method according to claim 1 wherein the fluffed asbestos fiber is suspended and deposited on net type electrodes.

6. A method according to claim 1 wherein the fluffed asbestos fiber is suspended and deposited on net type electrodes in a cell.

* * * * *